United States Patent [19]

Le Parquier et al.

[11] Patent Number: 5,070,790

[45] Date of Patent: Dec. 10, 1991

[54] TARGET MARKER TO ATTRACT PROJECTILES PROVIDED WITH A HOMING HEAD

[75] Inventors: Guy Le Parquier, Versailles; Jean Dansac, Chateaufort; Jean-Pierre Murgue, Sevres; Paul Sergent, Bures S/Yvette, all of France

[73] Assignee: Thomson-CSF, Puteaux, France

[21] Appl. No.: 486,353

[22] Filed: Feb. 28, 1990

[30] Foreign Application Priority Data

Mar. 14, 1989 [FR] France ..... 89 03312

[51] Int. Cl.[5] ..... F42B 12/40

[52] U.S. Cl. ..... 102/513; 102/293; 102/394

[58] Field of Search ..... 102/293, 334, 394, 404, 102/425, 427, 513

[56] References Cited

U.S. PATENT DOCUMENTS

| | | | |
|---|---|---|---|
| 3,156,185 | 10/1964 | Hermann et al. | 102/293 |
| 3,308,760 | 3/1967 | Peters | 102/427 |
| 3,835,749 | 9/1974 | Joneaux | 89/1.8 |
| 3,983,817 | 10/1976 | Tucker | 102/513 |
| 4,281,809 | 8/1981 | Oglesby et al. | 244/3.16 |
| 4,448,106 | 5/1984 | Knapp | 102/513 |
| 4,589,340 | 5/1986 | Hellwig et al. | 102/293 |
| 4,722,282 | 2/1988 | Synofzik et al. | 102/513 |
| 4,969,398 | 11/1990 | Lundwall | 102/293 |

FOREIGN PATENT DOCUMENTS

| | | |
|---|---|---|
| 3421607 | 12/1985 | Fed. Rep. of Germany . |
| 2029943 | 3/1980 | United Kingdom . |
| 2201494 | 9/1988 | United Kingdom . |

*Primary Examiner*—Harold J. Tudor

*Attorney, Agent, or Firm*—Oblon, Spivak, McClelland, Maier & Neustadt

[57] ABSTRACT

A marker that can be used to increase the precision and efficiency of the guidance of homing heads towards a target. In order to mark targets on land, this marker has: an ovoid casing provided with a firing fuse, and a magnet and a coil for detecting flux variations during an impact on a magnetic surface. Inside the casing there are: a battery, an electronic control and transmission circuit, and a cylinder of thrustors connected to one another by pyrotechnical delaying mechanisms. The cylinder opens out on to a single nozzle which is inclined with respect to the axis of the casing. After impact on the ground, the electronic circuit controls the firing of the first thrustor. The other thrustors cause leaps until the marker gets fixed to a magnetic surface, through the magnet. After detection of a flux variation, the electronic circuit actuates the firing of the fuse, to eject the casing and the cylinder of thrustors, and triggers a microwave or infra-red transmitter, depending on the homing head to be attracted.

8 Claims, 5 Drawing Sheets

Section a_a

Section b_b

TARGET MARKER TO ATTRACT PROJECTILES PROVIDED WITH A HOMING HEAD

BACKGROUND OF THE INVENTION

1. Field of the Invention

The present invention concerns a target marker to attract projectiles provided with a homing head.

The invention concerns the field of homing heads, and is aimed at improving their precision and effectiveness against targets, notably moving targets on land, such as wheeled or tracked vehicles.

2. Description of the Related Art

A known method of attaining this goal consists in illuminating the target, generally with a laser beam. For an air-to-ground attack, this calls for the implementation of a complicated system mounted on board a pod beneath the carrier aircraft. The homing head is guided by the laser wave reflected by the land target.

SUMMARY OF THE INVENTION

This method has been taken up in the present invention but modified so that the illuminator is no longer located at a distance from the target but on it. This illuminator is formed by a marker which comes to rest on the target, without the knowledge of the operating personnel on board the target.

The marker device is released or thrown above the zone that includes a target to be marked. It is arranged so that it can get fixed to this target after a searching stage and can then activate a transmitter. Depending on the type of homing head to be attracted (missile, airborne equipment, mine with directional control, etc.), the transmitted waves may be microwaves or infrared waves.

The marking thus obtained provides for a notable increase in the precision and efficiency of the guidance of the homing head, and for a reduction in the price of this homing head.

According to the invention, there is proposed a target marker to attract projectiles provided with a homing head, said marker comprising:

an ovoid casing having a flat end located in the vicinity of the center of gravity of the marker in such a way that the marker has only one stable position and always comes to rest on this end;

propulsion means, it being possible to stop the propulsion by an electrical control signal;

fixing means;

means to transmit a signal capable of attracting homing heads, said means being capable of being activated by an electrical control signal;

control means to detect a variation in magnetic flux and to then give a control signal to the propulsion means and to the means for transmission.

BRIEF DESCRIPTION OF THE DRAWINGS

The particular features and advantages of the invention will appear from the following description and from the appended figures.

DESCRIPTION OF PREFERRED EMBODIMENTS

The aim is to launch markers towards a formation of targets, for example armored vehicles. These markers are to get fixed to the targets and then activate a transmitter, which is either a microwave or an infra-red transmitter.

If the markers were not provided with propulsion means, the number of markers needed to cover the zone of the formation of vehicles would be too great for an economical solution despite the moderate cost of a marker. To reduce their number, the markers according to the invention are designed to go through a searching stage after release and impact on the ground. The technique of the multiple bounding mine is used. The marker moves several times until it finds a target. The total number of jumps that can be made may be several tens. When it touches a target, the marker detects its presence by its magnetic field, or by vibrations that it produces.

The marker may be considered to be a sub-munition released by an air carrier which may be a missile, a bomb, a rocket etc. The carrier releases a hundred or more of these sub-munitions.

Figure 1:
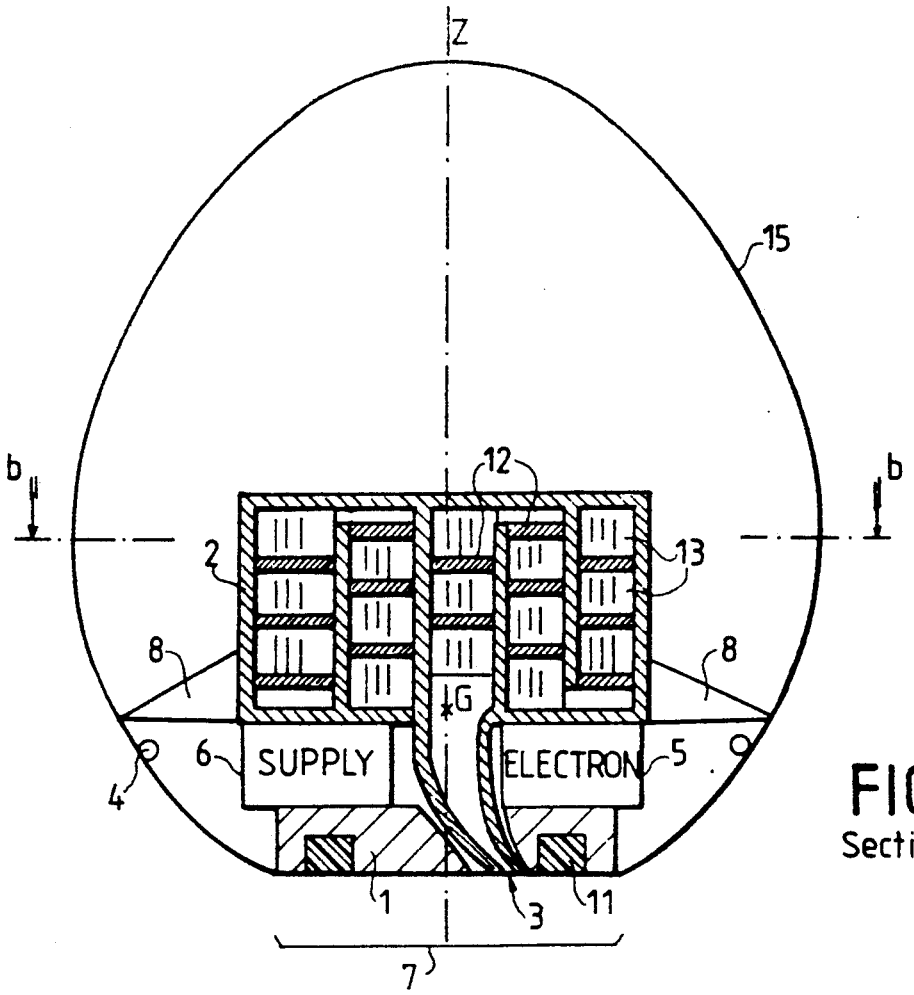
FIG. 1 shows a view in an axial section of a first exemplary embodiment of the marker according to the invention.
Figure 2:
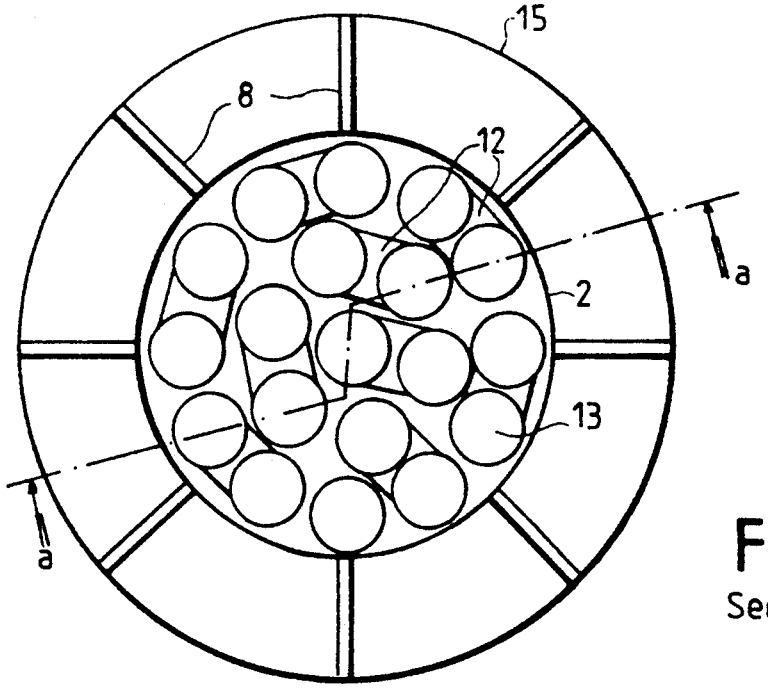
FIG. 2 shows a view, in a cross-section, of this first exemplary embodiment.

FIGS. 1 and 2 give a schematic view of a first exemplary embodiment of the marker according to the invention, which gets fixed to the target by a magnet.

The marker has an ovoid external casing 15 having a flat end 7, and its internal mass is distributed in such a way that its center of gravity G is close to the flat end 7, so that the marker has only one stable position. After a fall, it always returns to this position of equilibrium.

This first exemplary embodiment has: a permanent magnet 1 that is flush with the flat end 7, a cylinder of thrustors 2 opening out into a single nozzle 3 that goes through the magnet 1, a detonating fuse 4 to eject the cylinder 2, an electronic circuit 5, and a supply 6. The elements 5 and 6 are located between the magnet 1 and the cylinder 2. The electronic circuit 5 includes a microwave or infra-red transmitter.

The magnet 1 has a magnetized core with a strong coercive field and a magnetic circuit. This magnet may be either rigid or flexible to enable it to cling more efficiently to a wall and stay there despite vibrations. Around the core, there is a coil 11 designed to detect a variation in flux upon impact on a magnetic surface, in order to stop the marker from jumping once it is fixed to a target. The coil 11 is, for example, circular and is housed in a hollowed out part of the magnet 1, which is made in the external face applied to the magnetic surface of the target.

The thrustors are distributed in a cylinder 2 for they cannot be positioned simply around the marker device, unless they are triggered in pairs. This would constitute an additional constraint on the firing and would consume excessive energy. The distribution of the thrustors in the cylinder 2 is either radial or vertical, in one or more layers, simply or in tandem.

FIG. 2 shows a sectional view of this first exemplary embodiment, showing a cylinder 2 formed by 19 charges of three elements 13, connected by pyrotechnical delaying mechanisms 12.

To make the jumps of the marker on the ground as efficient as possible, it is necessary to apply a thrust that is inclined from the vertical and goes through the center of gravity.

Figure 3:
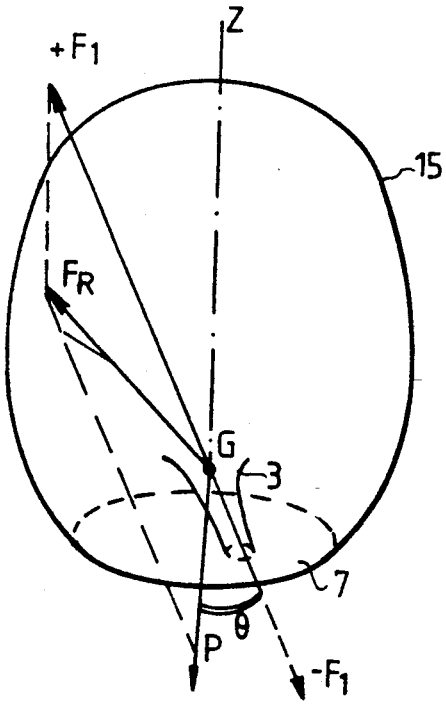
FIG. 3 shows a drawing related to the mode of propulsion of the marker device after impact on the ground.

FIG. 3 shows the forces acting on the marker: P represents the weight going through G the center of gravity, $-F_1$ represents the force of the gases leaving the nozzle 3; $F_1$ represents the thrust applied to the center of gravity G, and $F_R$ represents the resultant force, along which the marker is launched. The angle 8 of the nozzle 3 with the longitudinal axis Z of the casing 15 is about 30°, so that the resultant force FR is inclined.

A ground impact detector, for example of the piezoelectrical type, would give insufficient energy during successive landings on soft ground. Amplification and electrical firing by each thrustor would lead to high electrical consumption. To avoid these two drawbacks, the charges 13 are connected by pyrotechnical delaying devices 12, each having a duration that is slightly greater than that of a jump, so as to leave the electrical circuit 5 the time needed to take a decision on whether to continue the search or not. A firing device, controllable by an electrical signal, fires the first charge during the initial shock and then the charges 13 are triggered successively.

Figure 4:
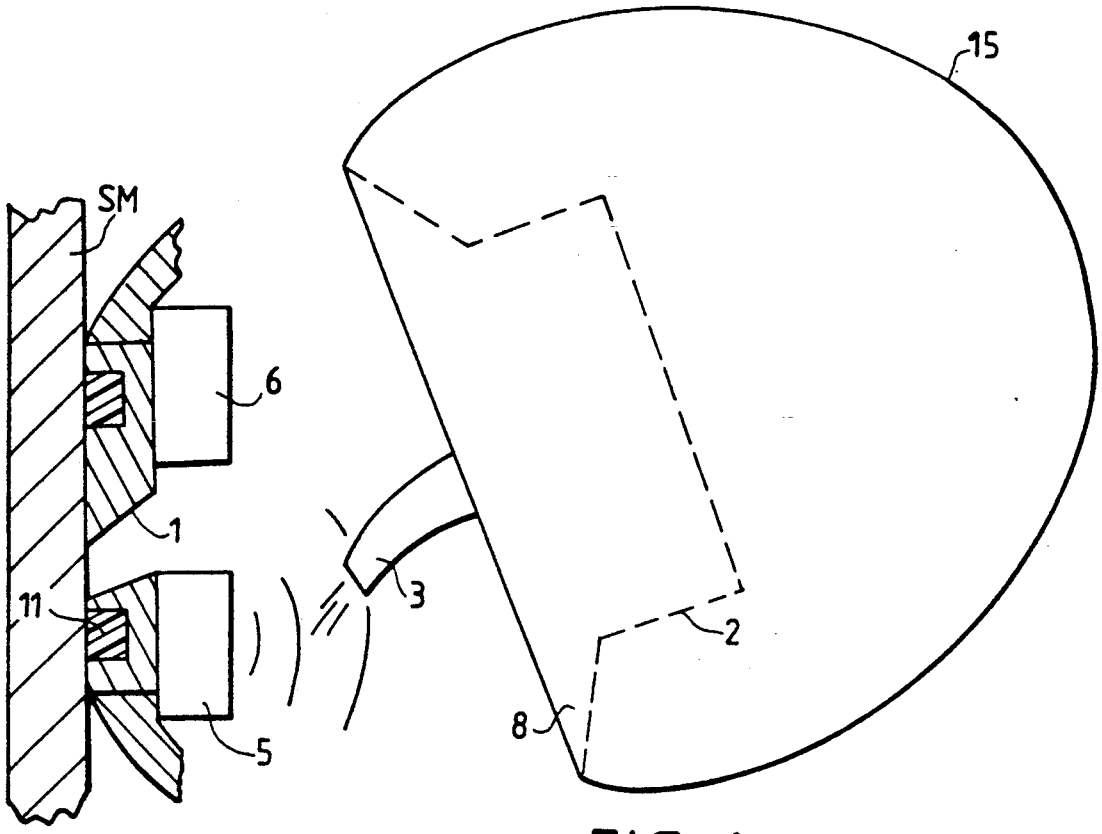
FIG. 4 illustrates the working of this first exemplary embodiment after it has been fixed to a magnetic surface.

FIG. 4 illustrates the working of this first exemplary embodiment when it hits a target having a magnetic wall. The magnet 1 clings to the magnetic wall SM. The coil 11 records the flux variation and produces a signal which is processed by the electronic circuit 5 to trigger the firing of a detonating fuse 4 (not shown in this figure) that goes around the casing 15 and divides it into two. This firing ejects the cylinder of thrustors 2, and the upper part of the casing 15. A part 8, which provides for the centered assembly of the cylinder of thrustors 2 and its fixed joining with the casing, is ejected too. The propulsion of the marker is thus stopped. The marker is lightened by approximately half of it weight, and remains easily fixed to the magnetic surface SM. The transmitter is put into operation.

Figure 5:
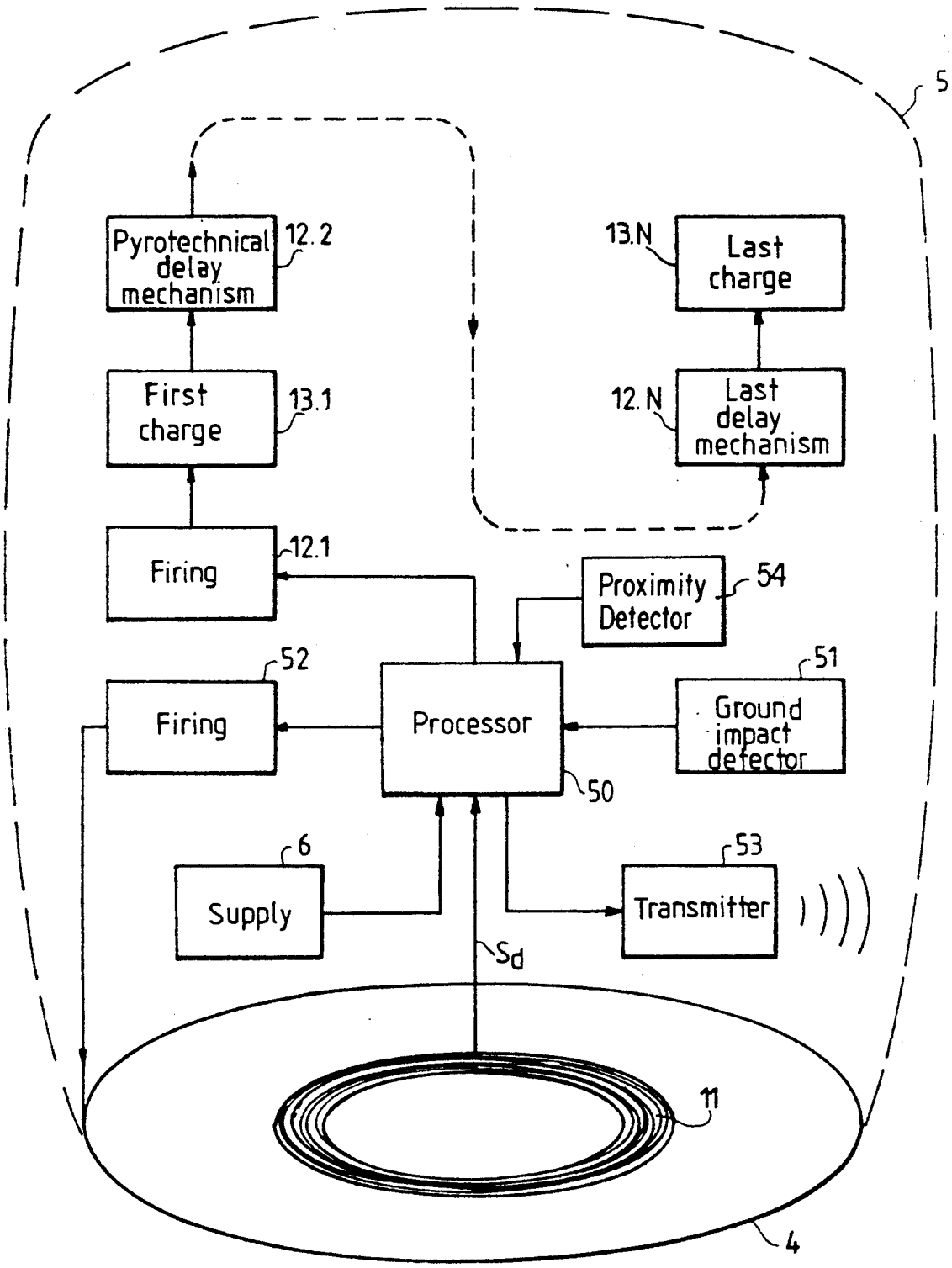
FIG. 5 gives a schematic view of the electrical circuit and of the pyrotechnical device used in the first exemplary embodiment.

FIG. 5 gives a schematic view of the electronic circuit 5 and the associated pyrotechnical device. It has: a ground impact detector 51, for example of the piezoelectrical type, which triggers a device 12.1 for the firing of the first charge 13.1. A second charge is then automatically fired by means of the first pyrotechnical delaying mechanism 12.2 and so on until the last charge 13.N. The pyrotechnical device gives a total of N successive pulses corresponding to the N charges which form it. If the landing on a magnetic surface takes place before the end of these N pulses, the variation in flux detected by the coil 11 produces a signal Sd which controls a device 52 for firing the cord 4 to stop the propulsion. This firing is accompanied by the putting into operation of a transmitter 53.

A processor circuit 50 provides for the performance of these various functions, but some of them may be performed by other, simpler means. For example, the discharging of a capacitor, directly controlled by the detector 51, may be used to trigger the first firing device 12.1.

According to one alternative embodiment, designed to provide for more efficient detection of the target upon landing, several criteria may be chosen: the first of these is the flux variation detected by the coil 11 and the second is the state of the vehicle (whether it is running or at a standstill) to prevent the marking of inert objects such as, for example, metal sheets, hangars, enclosures or destroyed vehicles. In this case, the piezoelectric sensor 51 is used to detect also the vibrations of the vehicle and take this second criterion into account. With a prior selection, for example by programming the processor 50, the marker could take only one criterion or both into account. When the selected criterion or criteria have been met, the detonating fuse 4 is fired.

According to one exemplary embodiment, each thrustor contains one gram of explosive powder, with a specific impulse of 2500. If the entire marker weighs about 200 g, the initial speed is 12.5 m/s. With an direction of the thrust at 30° to the vertical, the jumps are to a height of about 6 m and a length of about 14 m, and last about two seconds.

If the projectile to be guided is fitted out with a 1-decimeter square antenna and if the band, when locked into, is a 100 kHz band, then a 10 mW microwave transmitter is enough to provide for a signal-to-noise ratio equal to 20 dB for locking in at 10 km, and 40 dB for locking in at one km. The choice of the wavelength is a compromise between the selectivity desired in order to avoid counter-measures and the precision needed for locking in.

In the case of an infra-red optical transmitter, a marker device with omni-directional radiation may include laser integrated circuits, or electroluminescent diodes and a diffractive lens. The transmitted power may also be equal to 10 to 100 mW depending on the range desired and the cost envisaged for the marker.

The supply 6 may be formed by a deferred-action battery: this approach provides for a high degree of safety.

According to an alternative embodiment, the firing of the first charge is not triggered at the instant of arrival at the ground but subsequently, by an electromagnetic remote control signal, or by a proximity detector 54 (of the acoustic, vibrational or other type). The marker thus forms a waiting marker, called a "sleeping" or "latent" marker. It is possible to lay down or release markers such as these in a zone where targets to be reached could possibly pass through. The markers will then get laid on the vehicles when they pass nearby. The supply will be determined, in this type of operation, to take into account the energy needed for the proximity detectors for a certain duration. This variant can be used notably at sea to attract not missiles but torpedoes, propelled mines etc.

According to another alternative embodiment, the markers are fired from a firing station, for example that of anti-tank weapons, and their supply is not provided by a battery but through a connecting wire to a supply circuit located at the firing station. The system thus formed by the firing station and the remote markers then require no human intervention to fulfill the function of illumination.

According to another alternative embodiment, the fixing means are formed by a net designed to make the marker solidly fixed to a vehicle, the wall of which is not magnetic: for example, a vehicle having a body of plastic or reactive armoring. The magnetic fixing device is then partially replaced by a net folded inside the casing 15.

Figure 6:
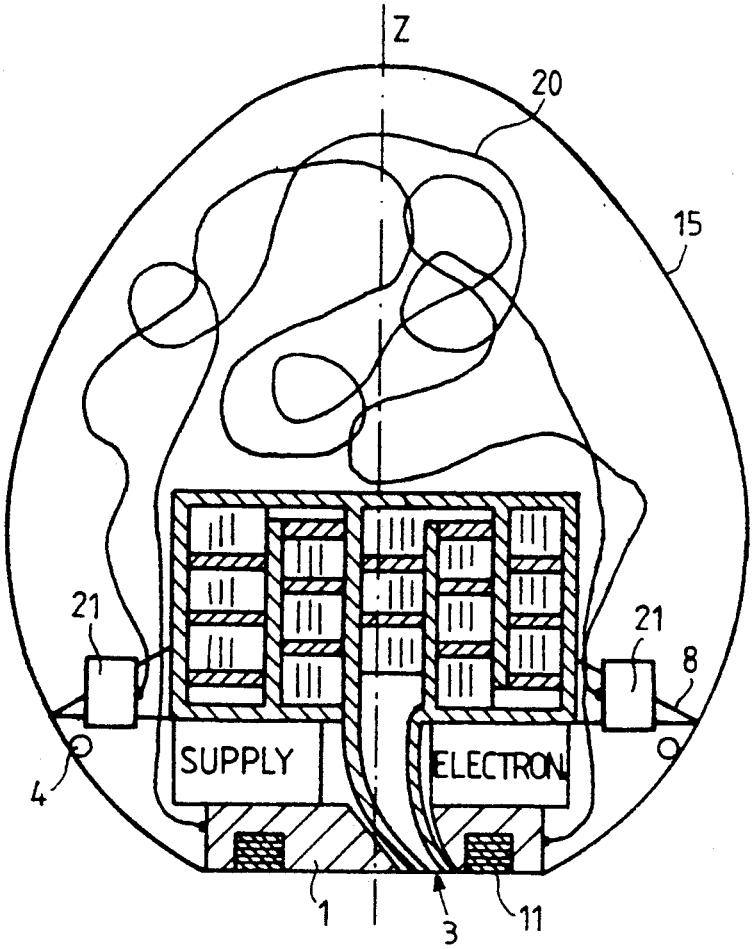
FIG. 6 shows a view, in an axial section, of a second exemplary embodiment of the marker according to the invention.

FIG. 6 gives a schematic view of a section of a second exemplary embodiment of the marker according to the invention including, in addition to the above-described elements, a net 20 folded inside the casing 15 and thrustors 21 designed to propel the net, just after the expulsion of the upper part of the casing 15 by the firing of the fuse 4. Like the first exemplary embodiment, this second example includes a magnet 1 and a coil 11. They can neither detect a non-magnetic wall nor fix the marker to it, but they can detect disturbances in the magnetic flux caused by elements other than the wall of the vehicle. This detection makes it possible to control the ejection of the net to grip the target.

Figure 7:
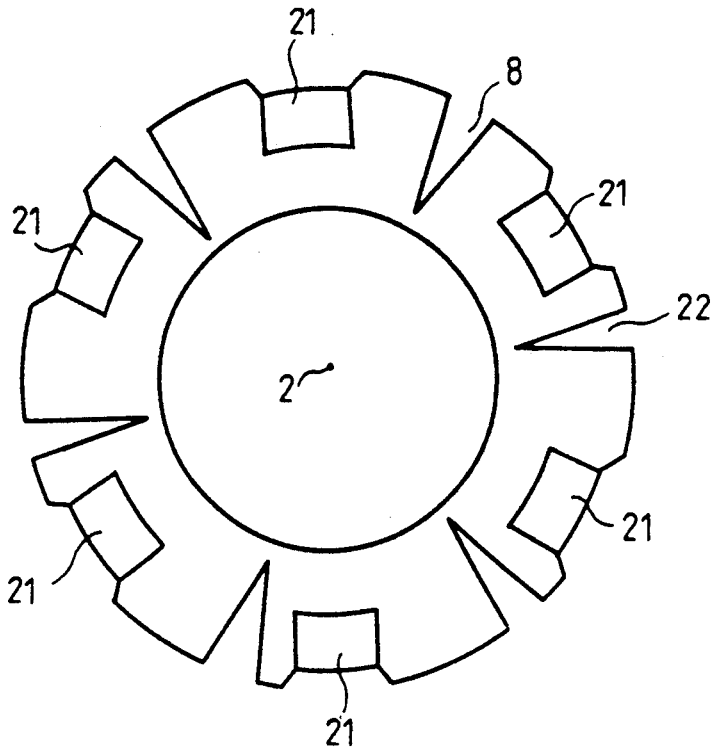
FIG. 7 shows a view of a part of this second exemplary embodiment.

FIG. 7 shows the arrangement of the cylinder of thrustors 2, for the propulsion of the marker, and the arrangement of six thrustors 21 designed to throw the net. The thrustors 21 are arranged evenly in a ring around the cylinder 2. Apertures 22 are cut out evenly in the part 8 to enable the ejection of the net 20.

Figure 9:
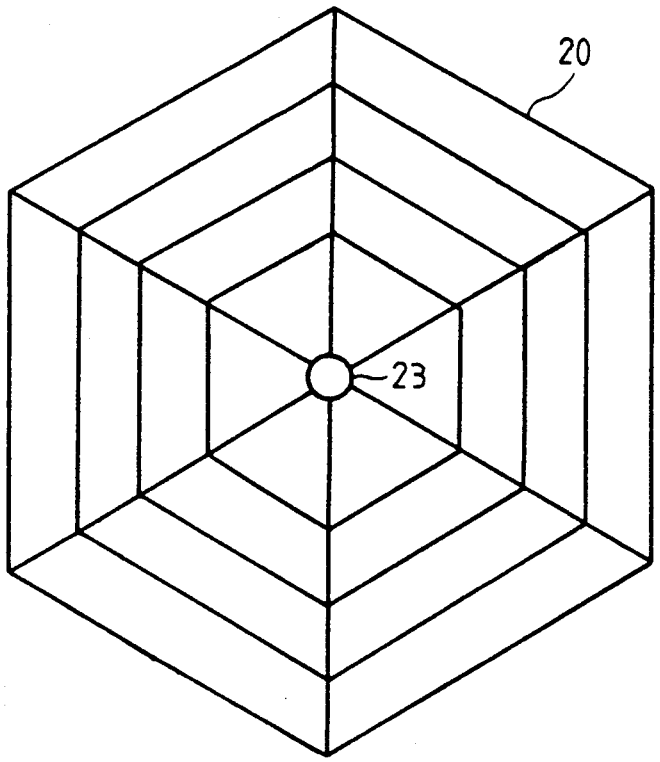
FIG. 9 shows a view of this second exemplary embodiment after it has deployed a net with which it is fitted out.

FIG. 9 shows the shape of the net 20 after it has been ejected from the marker. The net has six strands radiating evenly around the marker 23, these strands being connected by hexagonally shaped strands having a center of symmetry centered on the marker 23.

The net thus has the shape of a spider's web.

It may be formed by a steel wire or nylon thread with a very small diameter. The total mass of the net is thus equivalent to that of the magnet 1 of the first exemplary embodiment. If the fastening to the target is achieved only by a net, there remains only a small-sized magnet, designed solely to perceive the flux variations in the metallic parts. The total mass of the net and of this magnet may then be equal to that of the magnet 1 of the first exemplary embodiment. The total mass is then the same as compared with the first exemplary embodiment.

It is also possible to combine a magnetic fixing device and a net in one and the same marker, the use of the net being triggered only when the magnetic fixing device does not have a magnetic wall to get fixed to.

The diameter of the deployed net is designed in relation to the size of the targets to which the markers have to get fixed. This diameter may be about ten meters for example.

Figure 8:
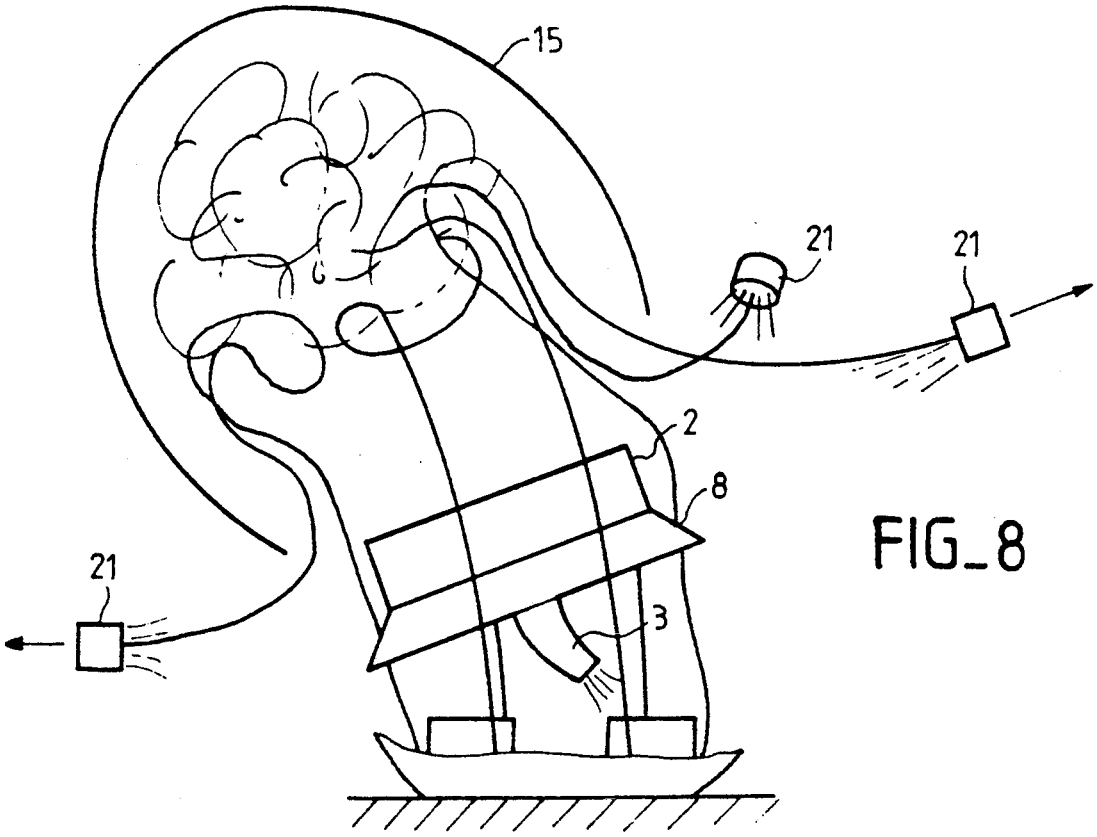
FIG. 8 illustrates the working of this second exemplary embodiment after it has detected the presence of a nearby target.

FIG. 8 illustrates the stage of operation during which the upper part of the casing 15 is ejected and the net is deployed by the firing of the thrustors 21. Simultaneously, the cylinder 2 is ejected and continues its leaps if the thrustors that it contains have not all been used.

What is claimed is:

1. A target marker to attract projectiles provided with a homing head, said marker comprising:

an ovoid casing having a flat end located in the vicinity of a center of gravity of the marker in such a way that the marker has only one stable position and always comes to rest on this flat end;

propulsion means for producing a jumping movement of the marker;

fixing means for fixing the marker on a target;

fuse means for separating the propulsion means from the marker when the marker is fixed on a target;

transmitter means for transmitting a signal capable of attracting homing heads when the marker is fixed on a target;

impact detecting means for activating the propulsion means in response to vibrations due to an impact of the marker or a passage of a target in close proximity to the marker; and magnetic flux detecting means for detecting fixing of the marker to a target and activating the fuse means and the transmitter means when fixing of the marker to the target is detected.

2. A marker according to claim 1, designed more particularly for the marking of objects on land, wherein the propulsion means comprises successive pyrotechnical thrusters to provide for the movement of the marker by successive thrusts; and the impact detecting means triggering at least the first of said thrustors after the marker has fallen on the ground;

3. A marker according to claim 2, wherein said propulsion means include a cylinder of said successive thrustors opening out into a single nozzle, inclined with respect to the longitudinal axis of the casing, which is vertical.

4. A marker according to claim 2, wherein said impact detecting means comprises a piezoelectric impact detector to control a first and single firing device which fires a first thrustor, the other thrustors being connected by pyrotechnical delaying devices.

5. A device according to claim 1, wherein the fixing means include a permanent magnet located in the flat end of the casing.

6. A device according to claim 1, wherein the fixing means include a net which is deployed by a pyrotechnical device.

7. A device according to claim 1, wherein the transmission means transmit microwaves or infra-red waves.

8. A marker according to claim 1, wherein the impact detecting means includes a proximity detector that is triggered by the passage of a target.

* * * * *